United States Patent [19]

Braulke, III

[11] 4,114,022

[45] Sep. 12, 1978

[54] COMBINED HOT AIR AND STEAM HAIR DRYER

[76] Inventor: Herbert A. Braulke, III, 7 E. 14th St., New York, N.Y. 10003

[21] Appl. No.: 825,185

[22] Filed: Aug. 16, 1977

[51] Int. Cl.[2] ..... H05B 1/00; A45D 20/08; F24H 3/04; F22B 1/28

[52] U.S. Cl. ..... 219/362; 34/90; 34/97; 128/256; 132/9; 132/11 R; 219/273; 219/275; 219/276; 239/136; 239/137; 261/142

[58] Field of Search ..... 219/362, 271–276, 219/222, 373, 370; 132/7, 9, 111–118, 11 R; 128/256, 257, 192; 34/96–101, 243 R, 90, 91; 239/133–138; 261/142, 141; 21/117–126; 43/125–130

[56] References Cited

U.S. PATENT DOCUMENTS

| | | | |
|---|---|---|---|
| 2,662,332 | 12/1953 | McIntire | 219/273 UX |
| 2,817,000 | 12/1957 | Scheid | 219/362 |
| 2,849,736 | 9/1958 | Kohle | 219/273 UX |
| 3,200,535 | 8/1965 | Hession | 219/275 UX |
| 3,258,578 | 6/1966 | Ferris | 219/273 |
| 3,495,343 | 2/1970 | Duncanson | 219/275 UX |
| 3,645,007 | 2/1972 | Scott | 219/276 UX |
| 3,702,616 | 11/1972 | Mercer | 132/9 |
| 3,814,898 | 6/1974 | Levine | 219/362 |
| 3,903,904 | 9/1975 | Hemrich et al. | 21/273 UX |
| 3,947,659 | 3/1976 | Ono | 219/273 |

FOREIGN PATENT DOCUMENTS

| | | | |
|---|---|---|---|
| 267,323 | 6/1950 | Switzerland | 239/135 |

*Primary Examiner*—A. Bartis
*Attorney, Agent, or Firm*—Sydney B. Schlessel

[57] ABSTRACT

A combined hot air and steam hair dryer providing for discharge of hot air and steam through the same aperture, comprising a housing, constituting an air chamber, supported on a balancing base, and provided with a discharge aperture at the forward end and an air inlet means at the rear end, with a motor-powered fan in the latter to drive the air towards the aperture. Intermediate the ends of the housing are provided a plurality of heating coils and, forward thereof, adjacent the aperture, a steam generating casing enclosing a heat rod and having discharge holes in the direction of the aperture, with the heat rod, coils and motor interconnected to a lead wire leading to an electric source and simultaneously activated by a switch. The base contains a water reservoir provided with a pump, to which is connected a hollow tubing leading into the casing, with means to inject water from the reservoir thereinto, therein expanding the water into steam, to be sprayed from the discharge aperture with the hot air.

8 Claims, 6 Drawing Figures

ELECTRIC PUMP
FAN MOTOR
4
4

12
14
16
18
42
44
46
50
52
54
56
58
60
64
66
72
78
80
82
86
88
90
92
94
96
W

COMBINED HOT AIR AND STEAM HAIR DRYER

BACKGROUND OF THE INVENTION (a) Field of the invention

This invention relates to the field of hair dressing and styling, and has for its objective the creation of a blow dryer with a coordinated stream or vapor sprayer selectively functional through the blower aperture, for the dressing and styling of hair. In the dressing and styling of hair, for ladies particularly, it is necessary to wet the hair, wind tresses thereof around curlers or brushes, and then blow dry the hair, so as to form substantially long lasting waves, wisps, curls, flips, tendrils, and the like. Since human hair ranges from thin fine hair to coarse curly hair, the procedure must be accommodated to the particular texture of hair involved, that is to say, with a standard procedure, thin fine hair will tend to become limp, while coarse hair cannot be properly controlled and styled for any permanence. Thus, various hair textures require appropriate modifications of procedure. For example, hair which dries rapidly under the hot air blower requires further wettings in the process and a more limited time of exposure to heat, while other textures require a more extensive exposure. To accomplish these variations of application may require selective further sprayings of the hair involved during the drying and styling process.

(b) Prior art

In the present state of the art the methods of selective further wetting or spraying of the hair involved, during the course of the blow drying, are inconvenient and time consuming, and render a proper styling difficult, if not impossible. For this reason various efforts have been made heretofore to combine some for of spray or vapor ejection with the dryer itself, for greater convenience and expedition of operation, better results and to shorten the time consumed for the job. One such present device combines an independent pump-reservoir for water with, and attached to, the dryer, by means of which a mist or spray can be selectively ejected upon the hair through an independent spray nozzle (U.S. Pat. No. 3,905,379), but such spraying procedure merely provides a cold mist or spray to the hair. Another device (U.S. Pat. No. 3,947,659) combines an independent vapor ejection system with the hair blower, to eject a warm or hot spray to the hair involved and worked on, during the course of drying and styling, through a secondary nozzle, in dependent of the blower nozzle. Since this device requires both an independent ejection nozzle as well as a complete, independent heating system, unrelated to the blower system, its disadvantages in terms of structure, complication and function are obvious. It further requires movement of the device to varying positions, so that the air from the dryer and the spray from the secondary nozzle may be directed upon the particular section of hair treated.

BRIEF DESCRIPTION OF THE INVENTION

The aforementioned disadvantages are overcome by my invention, which provides a combined hot air and steam hair dryer, wherein both the hot air, and, selectively, steam or vapor spray, are ejected through a single nozzle or aperture of the dryer to the identical hair area involved, without unnecessary repositioning of the device, with both the blower system and the spraying system heated by a single heating system incorporated therein, and with the combined device held by one hand of the operator, leaving the other hand free to move and shape the hair being treated.

It is therefore the principal object of my invention to provide a combined hot air and steam hair dryer by which hot air and steam spray can be directed through a single aperture of the device to the identical hair area being worked on.

A second important object of my invention lies in the provision of a dryer of the type above described which is capable of being operated by one hand of the user, leaving the other hand free to touch, move, adjust and style the hair worked on simultaneously with its operation.

A third important object of my invention lies in the provision of a device of the type described, wherein the blower and spraying systems employ the same heating arrangement.

A fourth important object of my invention lies in the provision of a device of the type described which is provided with a wide discharge aperture for large area application without constant movement of the dryer.

Still another important object of my invention lies in the provision of a water reservoir, for the creation and development of the steam spray, which is readily and easily removable and refillable as required.

These and other salient objects, advantages and functional features of my invention will become more readily apparent from an examination of the following description, taken with the accompanyings drawings, wherein.

BRIEF DESCRIPTION OF THE DRAWINGS

FIG. 3 is a cross-sectional view, taken on lines 3—3 of FIG. 1;

Similar reference characters designate similar parts throughout the different views.

DETAILED DESCRIPTION OF THE INVENTION

Figure 1:
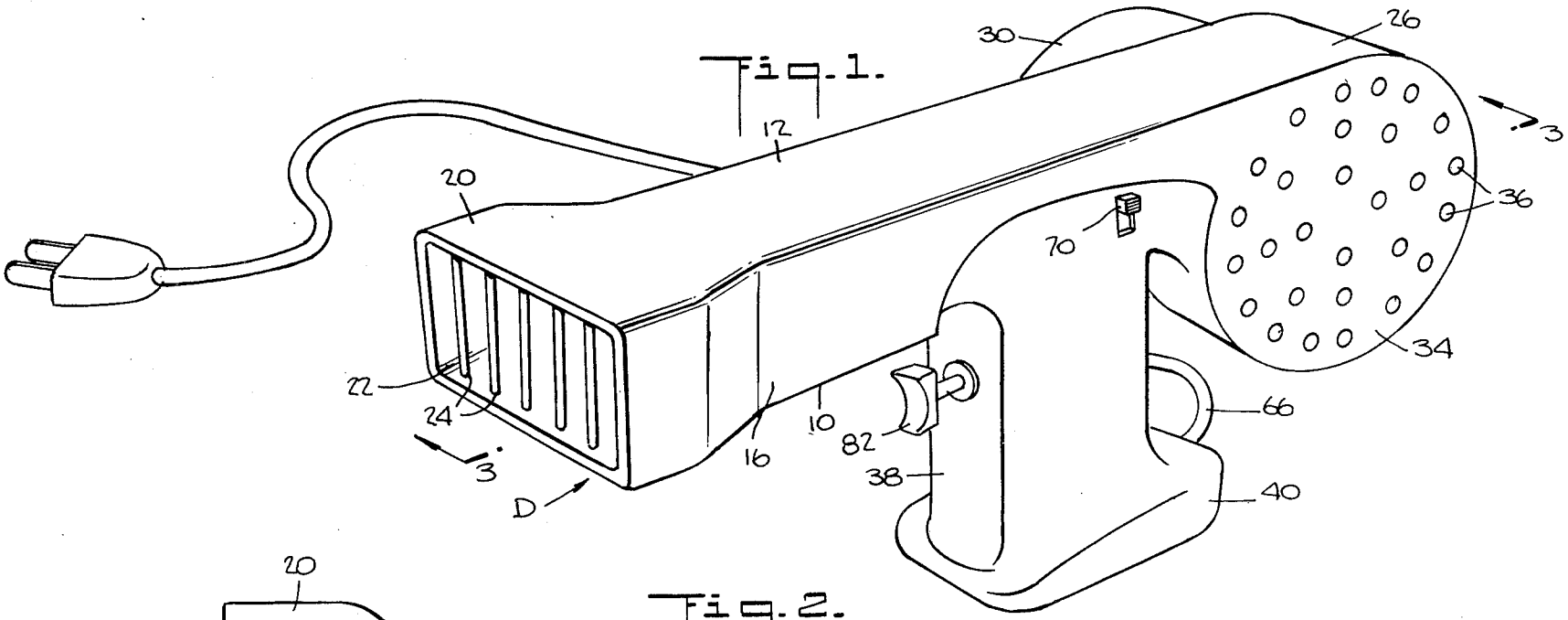
FIG. 1 is a side perspective view of a preferred embodiment of my invention.
Figure 2:
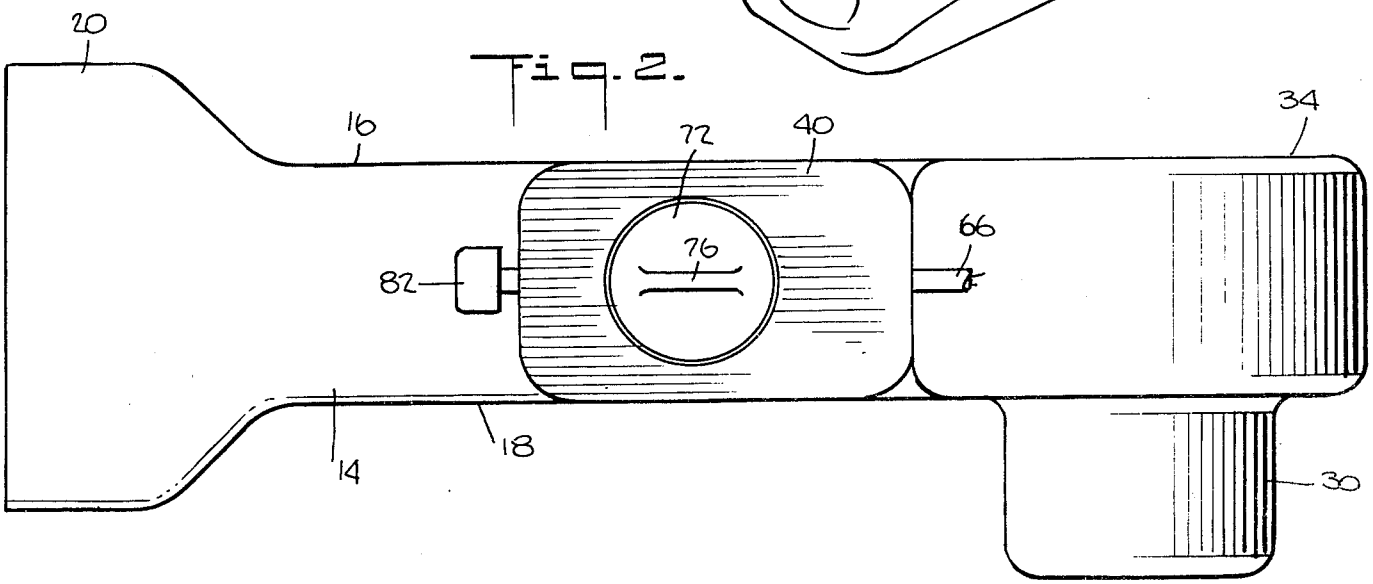
FIG. 2 is a bottom view of the embodiment of FIG. 1.

Illustrative of the embodiment shown by the drawings my combined hot air and steam hair dryer D comprises a hollow housing or shell 10 having a roof 12, floor 14, and side walls 16 and 18. The front end 20 of the housing 10 is flared to define an enlarged, substantially wide discharge aperture 22 provided with a series of protective bars 24, and the rear end 26 is enlarged and is extended laterally to contain and support a fan motor 28 in the extension 30. The fan blades 32 attached to the shaft of the motor 28 are disposed in the enlarged area 34 and are operative to direct air, sucked into the housing 10 through the air holes 36 provided adjacent thereto, in the direction of the aperture 22.

The housing 10 is provided centrally with a support post or base 38, of a diameter to permit the dryer D to be comfortably held and manipulated with one hand, with the base 38 so disposed as to equalize the weight from either end of the dryer D, so that the dryer D can be comfortably moved and turned. The lower edge of the base 38 is provided with an enlarged flange 40 so as to provide maximum stability to the dryer D when rested upon a flat surface.

Within the forward portion of the chamber 42 in housing a 10 roof 12 is formed with depending members 44, and the base 38 with a curved tongue 46 entering into the chamber 42 near its floor 14 and having raised members 48 corresponding to the depending members 44, to support and engage between them a series of heating coils 50 mounted on insulated supports 52, as shown.

Forward of the coils 50 the roof 12 of the chamber 42 is provided with a curved tongue member 54, from which there is suspended a wiring channel 56, which supports a steam generating casing 58 of horseshoe cross-section having a series of small holes 60 in its narrow wall 62 facing the aperture 22. A heat rod 64 is disposed laterally within the steam generating casing 58, with its utilization to be hereafter described.

Figures 5, 6:
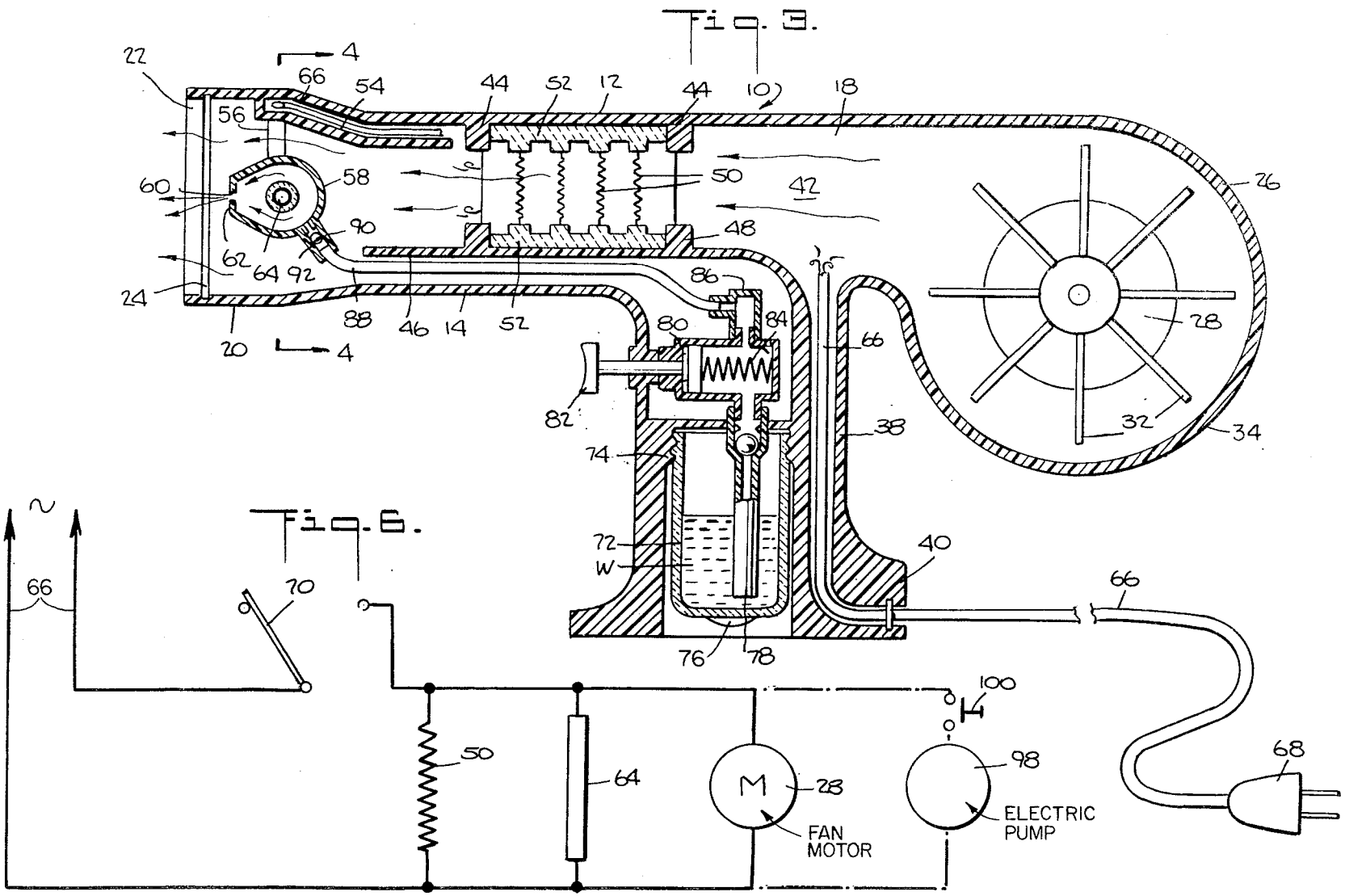
FIG. 5 is an enlarged exploded view, partly broken away, showing the construction of the steam spray elements.
FIG. 6 is a diagram of the electrical circuitry of the embodiment of FIG. 1.

The heat rod 64, coils 50 and motor 28 are connected in a circuit to lead wire 66, which terminated in plug 68 adapted for engagement to an electric source (not shown), and are activated simultaneously by means of a switch 70 located on the wall of the base 38, as shown in FIG. 1 and by FIG. 6.

Referring now to FIGS. 3 and 5, the hollow base 38 is provided with a water reservoir 72 which is secured to and within the base 38 as by a threaded engagement 74, and removeable therefrom by disengagement of the threads with the rotation of the reservoir 72 by means of the finger piece 76 recessed within the base 38. A tube 78 is connected to a pump 80 provided with a compression plunger 82 extending out of the base 38, as seen in FIG. 3, with the free end of the tube 78 submerged in the water W within the reservoir 72. A spring 84 disposed within the pump 80, as seen by FIG. 3, abuts the end of the plunger 82 and affords reciprocal movement of the latter to pump water from the reservoir 72. The top of the pump 80 is provided with a fitting 86 to which is connected on end of a hollow tubing 88 leading into the steam generating casing 58. The other end of the tubing 88 is secured by fitting 90, with a check valve 92 disposed within the fitting 90 and adapted to regulate the flow of water into the casing 58 and to prevent reentry of water therefrom into the tubing 88.

Figures 4, 5:
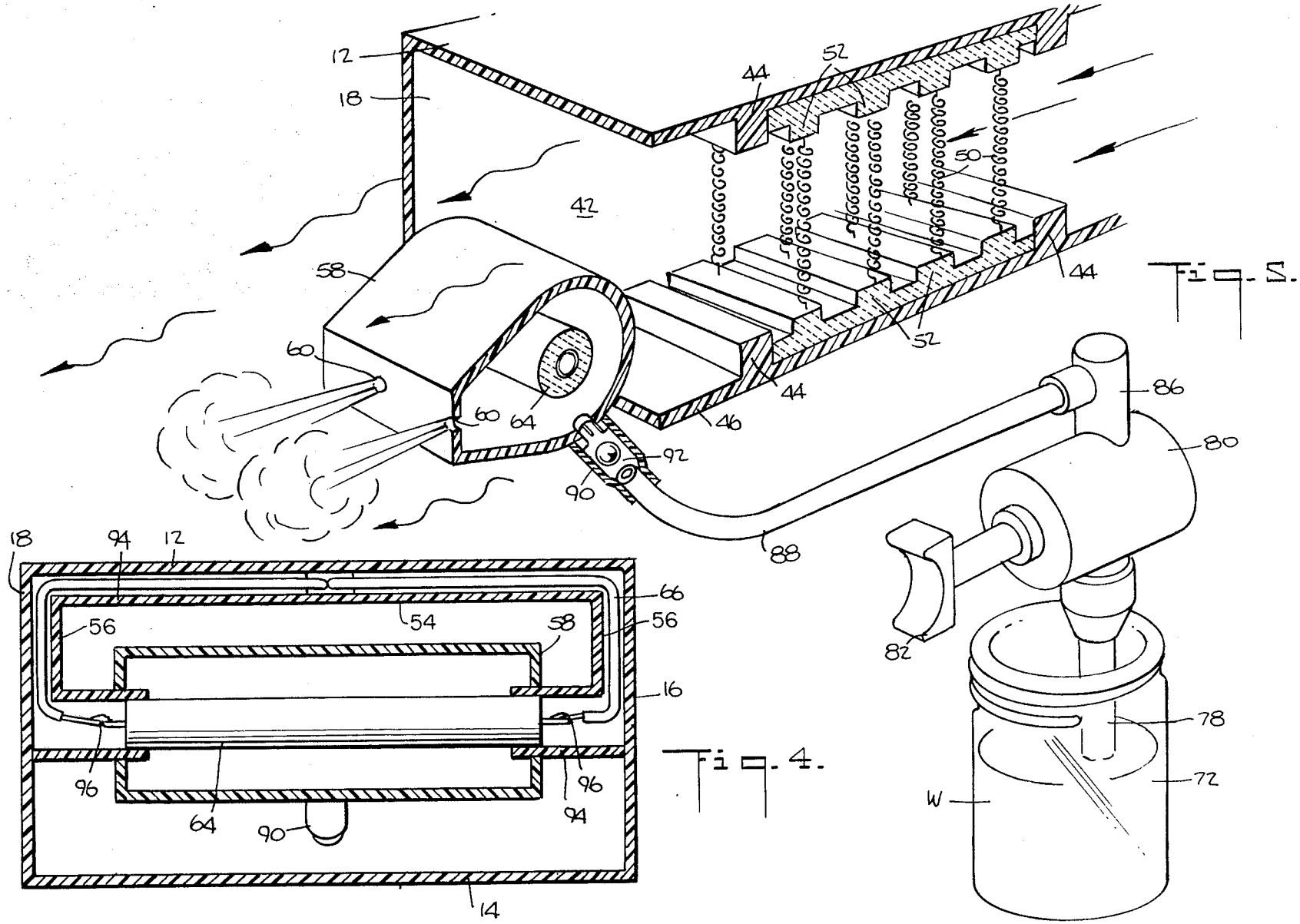
FIG. 4 is a cross-sectional view, taken on lines 4—4 of FIG. 3.

Referring now to FIG. 4, disposed behind the aperture 22 there is seen the interior of the casing 58, which is fitted with insulated supports 94 for the heat rod 64, which is thereby supported laterally within the casing 58 and engaged to terminals 96 of the lead wire 66 through the wiring channel 56, completing the circuit heretofore described

OPERATION OF THE INVENTION

In the operation of my invention the switch 70 is activated to close the circuit, thereby energizing the heat rod 64, coils 50 and the motor 28, causing air to be sucked into the chamber 42 through the air holes 36 and thence through the chamber 42 towards and through the aperture 22, with the air passing through the heat coils 50 and around the casing 58, as shown by the arrows in FIG. 5, thereby being doubly heated by the coils 50 and heat rod 64 before discharge.

When it is desired to spray the hair being dried and styled, the operator compresses the plunger 82 several times to force water from the reservoir 72 into the pump 80 and thence through the tubing 88 into the casing 58, whereby the water is injected against the heated walls of the casing 58 and against the heat rod 64. The heat generated within casing 58 is in excess of 220° F., whereby the water is expanded into steam which is forced out of the casing 58 through the holes 60 and through the aperture 22 in the form of a hot spray, the spray mingling with the hot air coming through the chamber 42 and propelled by the fan blades 32.

MODIFICATIONS OF THE INVENTION

While I have shown a preferred embodiment of my invention it is obvious to one skilled in the art that various changes of structure and elements may be made within its scope.

For example, instead of the manual pump 80 shown and described, an electrical pump can be substituted, which could be connected to the electrical circuit, as shown by the broken lines of FIG. 6, with the pump 98 activated by switch 100. There could also be substituted a pressurized container for the water, thereby eliminating the need for a pump.

Additionally, while the embodiment shown disclosed a single position switch 70, the unit could be designed with a positional switch to control the speed of the motor 28, as well as to control the degree of heat by removing and adding heat coils connected to the circuit.

Further, it is preferred that the housing 10 and base 38 be formed integrally in two sections of lightweight material, such as high temperature plastic. They may also be formed, alternatively, of any other material suitable for the purposes.

Consequently, it is to be understood that the embodiment shown and described is by way of illustration and not of limitation, and that various changes may be made in the construction, composition and arrangement of parts without limitation upon or departure from the spirit and scope of the invention, or sacrificing any of the advantages thereof inherent therein, all of which are herein claimed.

Having described my invention I claim:

1. A combined hot air and steam hair dryer comprising a hollow housing defining an air flow chamber and provided with a support base, a fan motor disposed in the rear of the housing, a discharge aperture provided in the front of the housing, fan means driven by said motor for drawing air into the chamber through a rear air inlet of said housing and discharging the air through the front aperture, electric heating means to heat the air passing through the air chamber, a steam generating casing within the air chamber in the air flow path through said chamber downstream of said air heating means and adjacent the discharge aperture and provided with openings facing the aperture, electric heating means disposed within the casing for generating steam, a water reservoir removeably secured within the support base, a pump having an inlet communicating with the reservoir, and an outlet connected to a hollow tubing leading from the pump into the steam generating casing, means to activate the pump means to inject water from the reservoir into the casing, the electric heating means within the chamber and within the casing, and the fan motor being connected in a circuit to a lead wire engageable to an electric source, and switch means to energize the circuit, whereby hot air is discharged through the aperture and steam is selectively discharged through the aperture in a spray.

2. A hair dryer as described in claim 1, the air inlet comprising a plurality of openings in the wall of the housing adjacent the blades of the fan.

3. A hair dryer as described in claim 2, the electric heating means to heat the air passing through the chamber comprising a series of electric heating coils connected to the electrical circuit and insulated from the housing.

4. A hair dryer as described in claim 3, the electric heating means within the casing comprising a heat rod.

5. A hair dryer as described in claim 1, the pump means comprising a manual pump provided with a piston plunger extending out of the wall of the support base and arranged in engagement with a spring member within the pump, whereby reciprocative compression and release of the piston plunger forces water from the reservoir through the hollow tube and into the steam generating casing.

6. A hair dryer as described in claim 1, the pump means comprising an electrical pump connected to the electrical circuit and activated by a switch member disposed on the support base of the dryer.

7. A hair dryer as described in claim 1, the support base provided with a surrounding flange at its free end, to provide greater stability to the dryer at rest.

8. A hair dryer as described in claim 1, the frontal area of the housing being flared to define a substantially rectangular discharge aperture having its wider area on an horizontal plane.

* * * * *